US007174243B1

(12) United States Patent
Lightner et al.

(10) Patent No.: US 7,174,243 B1
(45) **Date of Patent: *Feb. 6, 2007**

(54) WIRELESS, INTERNET-BASED SYSTEM FOR TRANSMITTING AND ANALYZING GPS DATA

(75) Inventors: Bruce Lightner, La Jolla, CA (US); Larkin Hill Lowrey, Seabrook, TX (US); Mark Hunt, El Cajon, CA (US)

(73) Assignee: HTI IP, LLC, NY, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/841,724

(22) Filed: May 7, 2004

Related U.S. Application Data

(63) Continuation of application No. 10/301,010, filed on Nov. 21, 2002, now abandoned.

(60) Provisional application No. 60/339,119, filed on Dec. 6, 2001.

(51) Int. Cl.
*G08G 1/123* (2006.01)

(52) U.S. Cl. ..... 701/33; 701/29; 701/213; 340/989

(58) Field of Classification Search ..... 701/29, 701/30, 32, 33, 213, 96; 340/989, 426.18, 340/436

See application file for complete search history.

(56) References Cited

U.S. PATENT DOCUMENTS

| | | | |
|---|---|---|---|
| 3,748,894 | A | 7/1973 | White et al. |
| 4,258,421 | A | 3/1981 | Juhasz et al. |
| 4,602,127 | A | 7/1986 | Neely et al. |
| 4,690,475 | A | 9/1987 | McElroy |
| 4,694,408 | A | 9/1987 | Zaleski |
| 4,926,330 | A | 5/1990 | Abe et al. |
| 4,956,777 | A | 9/1990 | Cearley et al. |
| 5,003,317 | A | 3/1991 | Gray et al. |
| 5,026,293 | A | 6/1991 | Wilson |
| 5,050,080 | A | 9/1991 | Abe |
| 5,157,610 | A | 10/1992 | Asano et al. |
| 5,223,844 | A | 6/1993 | Mansell et al. |

(Continued)

FOREIGN PATENT DOCUMENTS

| | | |
|---|---|---|
| CA | 2133673 | 10/1994 |

(Continued)

OTHER PUBLICATIONS

RD-422061 A; Anonymous; Jun. 10, 1999; Abstract, Using Internet for vehicle diagnostics-enabling using to operate vehicle personal computer to direct web browser to vehicle diagnostics website . . . .

(Continued)

*Primary Examiner*—Thomas Black
*Assistant Examiner*—Brian J. Broadhead
(74) *Attorney, Agent, or Firm*—Stephen C. Glazier; Kirkpatrick & Lockhart Nicholson Graham LLP

(57) ABSTRACT

The invention provides a wireless, internet-based system for monitoring and analyzing both GPS and diagnostic data collected from a vehicle. Specifically, the present invention provides a system for collecting these types of data and analyzing them to provide improved determination and mapping of the vehicle's location.

15 Claims, 11 Drawing Sheets

U.S. PATENT DOCUMENTS 5,289,378 A 2/1994 Miller et al.
5,343,906 A 9/1994 Tibbals, III
5,442,553 A 8/1995 Parrillo
5,450,321 A 9/1995 Crane
5,463,567 A 10/1995 Boen et al.
5,473,540 A 12/1995 Schmitz
5,479,479 A 12/1995 Braitberg et al.
5,491,486 A 2/1996 Welles et al.
5,532,927 A 7/1996 Pink et al.
5,537,336 A 7/1996 Joyce
5,550,551 A 8/1996 Alesio
5,574,427 A 11/1996 Cavallaro
5,671,141 A 9/1997 Smith et al.
5,673,305 A 9/1997 Ross
5,680,328 A 10/1997 Skorupski et al.
5,732,074 A 3/1998 Spaur et al.
5,737,215 A 4/1998 Schricker et al.
5,754,965 A 5/1998 Hagenbuch
5,758,300 A 5/1998 Abe
5,774,828 A * 6/1998 Brunts et al. ..... 701/210
5,781,871 A 7/1998 Mezger et al.
5,797,134 A 8/1998 McMillan et al.
5,798,647 A 8/1998 Martin et al.
5,808,907 A 9/1998 Shetty et al.
5,828,585 A * 10/1998 Welk et al. ..... 702/96
5,850,209 A 12/1998 Lemke et al.
5,884,202 A 3/1999 Arjomand
5,928,292 A 7/1999 Miller et al.
5,941,918 A 8/1999 Blosser
5,964,821 A * 10/1999 Brunts et al. ..... 701/201
6,064,970 A 5/2000 McMillan et al.
6,104,988 A 8/2000 Klarer
6,141,611 A 10/2000 Mackey et al.
6,154,658 A 11/2000 Caci
6,167,426 A 12/2000 Payne et al.
6,236,933 B1 5/2001 Lang
6,240,295 B1 5/2001 Kennedy et al.
6,263,268 B1 7/2001 Nathanson
6,285,953 B1 9/2001 Harrison et al.
6,295,492 B1 9/2001 Lang et al.
6,338,152 B1 1/2002 Fera et al.
6,339,745 B1 * 1/2002 Novik ..... 701/208
6,354,868 B1 3/2002 Korczynski et al.
6,356,205 B1 3/2002 Salvo et al.
6,356,823 B1 3/2002 Iannotti et al.
6,400,701 B2 6/2002 Lin et al.
6,408,232 B1 6/2002 Cannon et al.
6,429,773 B1 8/2002 Schuyler
6,442,460 B1 8/2002 Larson et al.
6,459,988 B1 10/2002 Fan et al.
6,487,479 B1 11/2002 Nelson
6,487,494 B2 11/2002 Odinak et al.
6,487,717 B1 11/2002 Brunemann et al.
6,496,777 B2 12/2002 Tennison et al.
6,502,030 B2 12/2002 Hilleary
6,505,106 B1 1/2003 Lawrence et al.
6,507,786 B2 1/2003 Flick
6,522,267 B2 2/2003 Flick
6,526,335 B1 2/2003 Treyz et al.
6,526,460 B1 2/2003 Dauner et al.
6,529,159 B1 3/2003 Fan et al.
6,552,682 B1 4/2003 Fan
6,556,889 B2 4/2003 Rudick et al.
6,556,905 B1 4/2003 Mittelsteadt et al.
6,564,127 B1 5/2003 Bauerle et al.
6,580,916 B1 6/2003 Weisshaar et al.
6,594,576 B2 7/2003 Fan et al.
6,594,579 B1 7/2003 Lowrey et al.
6,604,032 B1 8/2003 Moller
6,604,033 B1 8/2003 Banet et al.
6,604,038 B1 8/2003 Lesesky et al.
6,609,051 B2 8/2003 Fiechter et al.
6,611,686 B1 8/2003 Smith et al.
6,611,739 B1 8/2003 Harvey et al.
6,611,740 B2 8/2003 Lowrey et al.
6,611,755 B1 8/2003 Coffee et al.
6,636,790 B1 10/2003 Lightner et al.
6,664,922 B1 12/2003 Fan
6,675,081 B2 1/2004 Shuman et al.
6,687,587 B2 2/2004 Kacel
6,694,234 B2 * 2/2004 Lockwood et al. ..... 701/29
6,718,425 B1 4/2004 Pajakowski et al.
6,732,031 B1 5/2004 Lightner et al.
6,732,032 B1 5/2004 Banet et al.
6,751,452 B1 6/2004 Kupczyk et al.
6,754,485 B1 6/2004 Obradovich et al.
6,795,017 B1 9/2004 Puranik et al.
6,832,140 B2 12/2004 Fan et al.
6,836,708 B2 12/2004 Tripathi
6,845,362 B2 * 1/2005 Furuta et al. ..... 705/13
6,862,524 B1 3/2005 Nagda et al.
6,867,733 B2 3/2005 Sandhu et al.
6,882,313 B1 4/2005 Fan et al.
6,889,064 B2 5/2005 Baratono et al.
6,922,566 B2 7/2005 Puranik et al.
2001/0016789 A1 8/2001 Staiger
2001/0033225 A1 10/2001 Razavi et al.
2002/0008644 A1 1/2002 Lim et al.
2002/0008645 A1 1/2002 Flick et al.
2002/0016655 A1 2/2002 Joao
2002/0029101 A1 3/2002 Larson et al.
2002/0032505 A1 3/2002 Good
2002/0078458 A1 6/2002 Furon et al.
2002/0118222 A1 8/2002 Fogarty
2002/0133273 A1 9/2002 Lowrey et al.
2002/0140545 A1 10/2002 Nietupski et al.
2002/0143446 A1 10/2002 Rogers et al.
2002/0150050 A1 10/2002 Nathanson
2002/0173889 A1 11/2002 Odinak et al.
2002/0177476 A1 11/2002 Chou
2003/0004623 A1 1/2003 Namaky et al.
2003/0004624 A1 1/2003 Wilson et al.
2003/0009270 A1 1/2003 Breed
2003/0078722 A1 4/2003 Odinak et al.
2003/0083809 A1 * 5/2003 Hatano ..... 701/207
2003/0093204 A1 5/2003 Adachi et al.
2003/0130005 A1 7/2003 Weisshaar et al.
2003/0130774 A1 7/2003 Tripathi et al.
2003/0139179 A1 7/2003 Fuchs et al.
2003/0147534 A1 8/2003 Ablay et al.
2003/0182055 A1 9/2003 Curatolo et al.
2003/0231118 A1 12/2003 Kitson
2003/0236596 A1 12/2003 Eisenmann et al.
2004/0023645 A1 2/2004 Olsen et al.
2004/0039502 A1 2/2004 Wilson et al.
2004/0044454 A1 3/2004 Ross et al.
2004/0075539 A1 * 4/2004 Savoie et al. ..... 340/426.1
2004/0104842 A1 * 6/2004 Drury et al. ..... 342/357.13
2004/0196182 A1 10/2004 Unnold
2005/0144318 A1 6/2005 Chang

FOREIGN PATENT DOCUMENTS

EP 0816820 A2 1/1998
WO WO 00/40038 7/2000
WO WO 00/79727 12/2000

OTHER PUBLICATIONS

Bary W. Wilson et al., Modular system for multiparameter in-line machine fluid analysis (Technology showcase Apr. 3-6, 2000).
40 CFR 85, Ch. I (Jul. 1, 2001 Edition), pp. 502-640.
Motorola, Inc., "Automotive ISO 9141 Serial Link Driver," 1996, p. 1-12.

D. John Oliver, Intel Corporation, "Implementing the J 1850 Protocol".
U.S. Appl. No. 09/776,033, filed Feb. 1, 2001, Banet et al.
U.S. Appl. No. 09/776,083, filed Feb. 1, 2001, Banet et al.
U.S. Appl. No. 09/776,106, filed Feb. 1, 2001, Lightner et al.
U.S. Appl. No. 09/804,888, filed Mar. 13, 2001, Lowrey et al.
U.S. Appl. No. 09/808,690, filed Mar. 14, 2001, Lowrey et al.
U.S. Appl. No. 09/908,440, filed Jul. 18, 2001, Lightner et al.
U.S. Appl. No. 09/922,954, filed Aug. 6, 2001, Lowrey et al.
U.S. Appl. No. 10/301,010, filed Nov. 21, 2002, Lightner et al.
U.S. Appl. No. 10/431,947, filed May 8, 2003, Hunt et al.
U.S. Appl. No. 10/447,713, filed May 29, 2003, Lightner et al.
U.S. Appl. No. 10/456,246, filed Jun. 6, 2003, Lowrey et al.
U.S. Appl. No. 10/456,788, filed Jun. 6, 2003, Banet et al.
U.S. Appl. No. 10/614,665, filed Jul. 7, 2003, Lowrey et al.
U.S. Appl. No. 10/615,516, filed Jul. 8, 2003, Lightner et al.
U.S. Appl. No. 10/625,942, filed Jul. 24, 2003, Banet et al.
U.S. Appl. No. 10/626,779, filed Jul. 24, 2003, Lightner et al.
U.S. Appl. No. 10/626,810, filed Jul. 24, 2003, Lowrey et al.
U.S. Appl. No. 10/632,033, filed Jul. 31, 2003, Banet et al.
U.S. Appl. No. 10/810,373, filed Mar. 26, 2004, Lowrey et al.
U.S. Appl. No. 10/823,478, filed Apr. 13, 2004, Williams et al.
U.S. Appl. No. 10/831,952, filed Apr. 26, 2004, Hunt et al.
U.S. Appl. No. 10/440,596, filed May 19, 2003, Lang et al.
Frank Di Genova, Thomas C. Austin, S. Kingsley Macomber (Sierra Research, Inc.). Incorporation of Wireless Communications into Vehicle On-Board Diagnostic (OBD) Systems. Report No. SR00-01-03 prepared for California Air Resources Board, Jan. 18, 2000.
Definition of "Chipset", Wikipedia, http://en.wikipedia.org/wiki/Chipset, Feb. 23, 2006.

* cited by examiner time = $t_2$ time = $t_1$

WIRELESS, INTERNET-BASED SYSTEM FOR TRANSMITTING AND ANALYZING GPS DATA

Under 35 U.S.C. §119(e)(1), this applications claims benefit of prior U.S. Provisional Application No. 60/339,119, entitled "WIRELESS, INTERNET-BASED SYSTEM FOR TRANSMITTING AND ANALYZING GPS DATA," filed Dec. 6, 2001, which is incorporated herein by reference.

This application is related to U.S. patent application Ser. No. 10/626,779, filed Jul. 24, 2003, the contents of which are incorporated herein by reference.

FIELD OF THE INVENTION

The present invention relates to a wireless, internet-based system for transmitting and analyzing data from an automotive vehicle.

BACKGROUND OF THE INVENTION

A conventional GPS features an antenna for receiving GPS signals from orbiting satellites and a chipset that processes these signals to calculate a GPS 'fix' featuring GPS data such as latitude, longitude, altitude, heading, and velocity. The latitude, longitude, and altitude describe the vehicle's location with a typical accuracy of about 10 meters or better.

Conventional GPSs can be combined with systems for collecting diagnostic data from the vehicle to form 'telematics' systems. Such diagnostic data is typically collected from OBD-II systems mandated by the Environmental Protection Agency (EPA) for monitoring light-duty automobiles and trucks beginning with model year 1996. OBD-II systems monitor the vehicle's electrical, mechanical, and emissions systems and generate data that are processed by a vehicle's engine control unit (ECU) to detect malfunctions or deterioration in the vehicle's performance. The data typically include parameters such as vehicle speed (VSS), engine speed (RPM), engine load (LOAD), and mass air flow (MAF). The ECU can also generate diagnostic trouble codes (DTCs), which are 5-digit codes (e.g., 'P0001') indicating electrical/mechanical problems with the vehicle. DTCs and other diagnostic data are made available through a standardized, serial 16-cavity connector referred to herein as an 'OBD-II connector'. The OBD-II connector is in electrical communication with the vehicle's ECU and typically lies underneath the vehicle's dashboard.

U.S. Pat. Nos. 6,064,970, 6,236,933, and 6,295,492, for example, describe in-vehicle systems that collect both GPS data and diagnostic data from the vehicle's OBD-II systems. The in-vehicle systems then transmit these data using wireless means to a host computer system.

BRIEF SUMMARY OF THE INVENTION

In one aspect, the invention provides a wireless, internet-based system for monitoring and analyzing GPS and diagnostic data from a vehicle. Specifically, there is a system for collecting these types of data and analyzing them to determine and map a vehicle's location and mechanical condition. These data, for example, can be used to provide services such as 'smart' roadside assistance to a disabled vehicle.

In another aspect, the invention provides a GPS-based system for alerting a vehicle's owner that someone other than the owner has moved the vehicle (e.g., the vehicle is stolen or towed). Here, an in-vehicle GPS system detects a change in a vehicle's position. This event triggers an 'instant message' or electronic mail, described in more detail below, that is sent to the owner and indicates the vehicle's location and that it has been moved.

More specifically, in one aspect, the invention provides a method that includes the steps of: 1) generating a diagnostic data set from the vehicle that features at least one diagnostic datum; 2) generating a location data set from the vehicle that features at least one GPS datum; 3) transferring the diagnostic and GPS data sets to a wireless appliance that includes a wireless transmitter; 4) transmitting the diagnostic and GPS data sets with the wireless transmitter over an airlink to a host computer system; 5) analyzing both the diagnostic and GPS data sets with the host computer system to characterize the vehicle; and 6) displaying the results of the analyzing step on at least one Internet-accessible web page.

In embodiments, the analyzing involves analyzing the diagnostic data set to determine the vehicle's mechanical condition, or analyzing the GPS data set to determine the vehicle's approximate location. The method can additionally include dispatching a second vehicle (e.g., for stolen-vehicle recovery or roadside assistance) following the analysis step. In other embodiments, the analyzing involves analyzing the diagnostic data set to determine properties such as the vehicle's fuel level, battery voltage, presence of any DTCs, speed, and/or odometer value.

In other embodiments, the analyzing further involves analyzing both the GPS datum and the vehicle's speed to determine the vehicle's location. The process of analyzing can also involve analyzing these data simultaneously to determine, e.g., a traffic condition, such as a real-time 'traffic map'.

In another aspect, the method analyzes the GPS data alone, and in response sends a message describing the vehicle's location. For example, the method can analyze the GPS data to determine a change in the vehicle's location. And then the method can send a text or voice message, such as an electronic mail message, instant message, or cellular telephone call, indicating the change to a user. In these messages the method can send the vehicle's location and an internet-based link to a map that graphically displays the vehicle's location. In some cases the map displays the current vehicle's location and at least one previous location or track indicating a route that the vehicle has traveled.

In another aspect, the method determines a vehicle's location by processing the vehicle's speed and GPS-determined location. In this way an accurate-location is determined even when GPS coverage is poor. In yet another aspect, the method analyzes both a GPS datum and a modified diagnostic datum (e.g., speed or odometer value) generated by processing the diagnostic datum with an algorithm (e.g., integration over time). These data are then used as described above.

In the below-described method, the term 'electronic mail' or 'email' refers to conventional electronic mail messages sent over a network, such as the Internet. Similarly, the terms 'instant message' or 'instant messaging' refers to conventional, Internet-based instant messaging, including services such as Yahoo!'s 'Messenger' and America On Line's 'Instant Messenger'.

The term 'web page' refers to a standard, single graphical user interface or 'page' that is hosted on the Internet or worldwide web. A 'web site' typically includes multiple web pages, many of which are 'linked' together and can be accessed through a series of 'mouse clicks'. Web pages typically include: 1) a 'graphical' component for displaying a user interface (typically written in a computer language called 'HTML' or hypertext mark-up language); an 'application' component that produces functional applications, e.g. sorting and customer registration, for the graphical functions on the page (typically written in, e.g., C++ or java); and a database component that accesses a relational database (typically written in a database-specific language, e.g. SQL*Plus for Oracle databases).

Embodiments of the invention have one or more of the following many advantages. In particular, wireless, real-time transmission and analysis of GPS and diagnostic data, followed by analysis and display of these data using an Internet-hosted web site, makes it possible to characterize the vehicle's performance and determine its location in real-time from virtually any location that has Internet access, provided the vehicle being tested includes the below-described wireless appliance. These data are complementary and, when analyzed together, can improve conventional services such as roadside assistance, vehicle theft notification and recovery, and remote diagnostics. For example, the data can indicate a vehicle's location, its fuel level and battery voltage, and whether or not it has any active DTCs. With these data a call center can dispatch a tow truck with the appropriate materials (e.g., extra gasoline or tools required to repair a specific problem) to repair the vehicle accordingly.

Analysis of both GPS and diagnostic data also improves the accuracy to which a vehicle's location is determined. For example, a vehicle's speed, when used in combination with GPS data, can be analyzed to extrapolate the vehicle's location. Speed and GPS data can also be simultaneously analyzed to accurately determine the error of a GPS-determined location, or to determine a vehicle's location when GPS coverage is compromised or not available.

The system also uses GPS data indicating a vehicle's location for services such as theft notification and recovery of stolen vehicles. For example, the system can transmit an email or instant message to the vehicle's owner if the vehicle has been stolen. The message includes a link to a website that displays the vehicle's GPS-determined location, thereby allowing the vehicle to be quickly recovered.

The wireless appliance used to access and transmit the GPS and diagnostic data is small, low-cost, and can be easily installed in nearly every vehicle with an OBD-II connector in a matter of minutes. It can also be easily transferred from one vehicle to another, or easily replaced if it malfunctions. No additional wiring is required to install the appliance; it is powered through the OBD-II connector and does not require a battery. The appliance can also be connected directly to a vehicle's electrical system, thus making it unnecessary to even use the OBD-II connector.

The following detailed disclosure describes these and other advantages of the invention.

BRIEF DESCRIPTION OF DRAWINGS

The features and advantages of the present invention can be understood by reference to the following detailed description taken with the drawings, in which.

DESCRIPTION OF THE PREFERRED EMBODIMENTS

Figure 1:
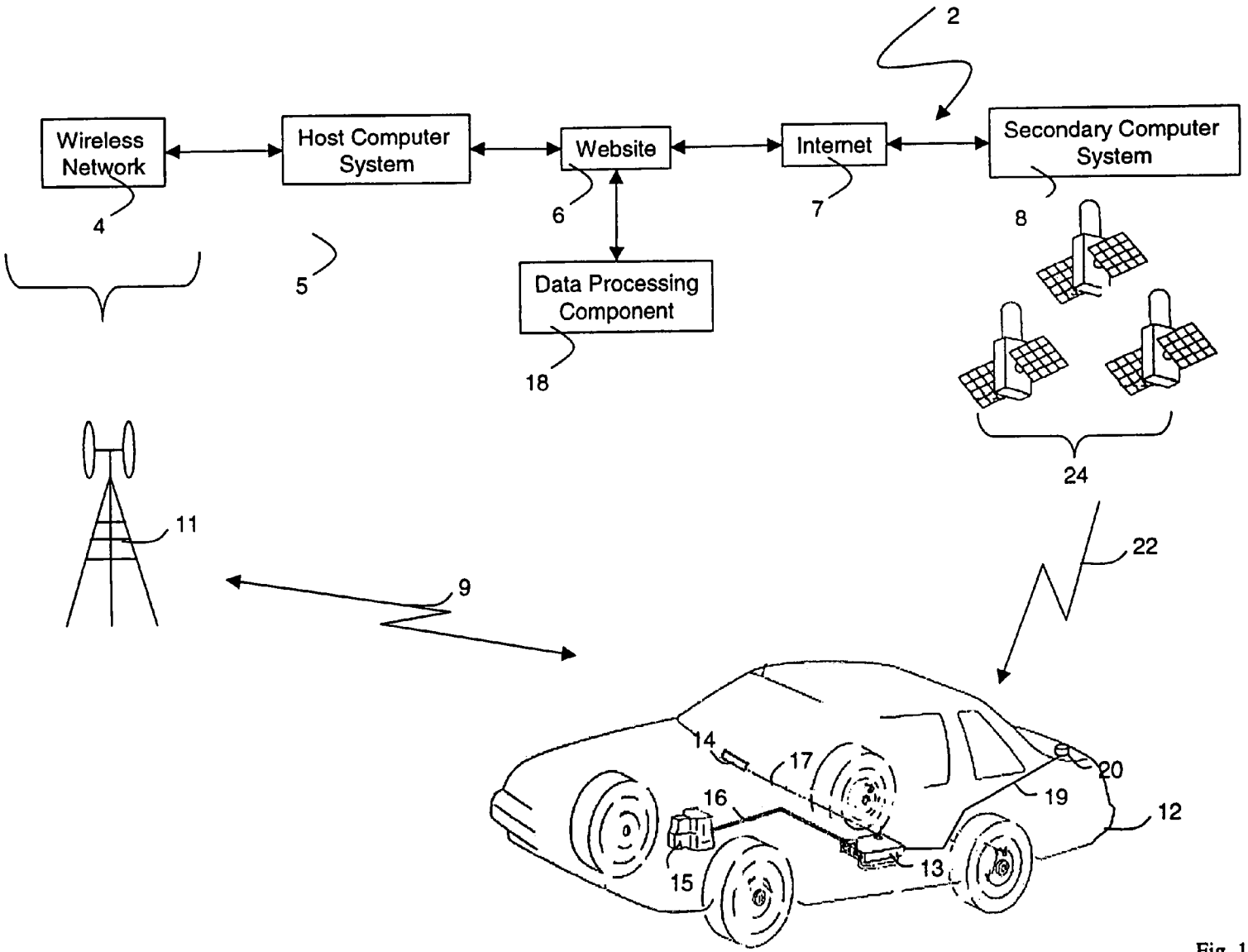
FIG. 1 is a schematic drawing of a vehicle featuring a wireless appliance that communicates with both GPS and wireless communication networks.

FIG. 1 shows a schematic drawing of an Internet-based system 2 that monitors both OBD-II diagnostic data and GPS data from a vehicle 12. A wireless appliance 13 (described in more detail with reference to FIG. 9) in the vehicle 12 includes data-collection electronics (not shown in the figure) that measure diagnostic data including mass air flow (MAF), engine load (LOAD), diagnostic trouble codes (DTCs), and speed (VSS). The wireless appliance also includes a GPS chipset (also not shown in FIG. 1 but later described with reference to FIG. 9) that measures the vehicle's latitude, longitude, altitude, heading, approximate speed, and the number of miles traveled since the GPS data was last measured.

The wireless appliance 13 formats the diagnostic and GPS data in separate data packets and transmits these packets over an airlink 9. As described in more detail below, the data packets propagate through a wireless network 4 and ultimately to a web site 6 hosted by a host computer system 5. A user (e.g. an individual working for a call center) accesses the web site 6 with secondary computer system 8 through the Internet 7. The host computer system 5 also features a data-processing component 18 that analyzes the GPS and diagnostic data as described in more detail below.

The wireless appliance 13 disposed within the vehicle 12 collects diagnostic data by querying the vehicle's engine computer 15 through a cable 16. In response to a query, the engine computer 15 retrieves data stored in its memory and sends it along the same cable 16 to the wireless appliance 13. The appliance 13 typically connects to an OBD-II connector (not shown in the figure) located under the vehicle's dashboard. This connector is mandated by the EPA and is present in nearly all vehicles manufactured after 1996.

The wireless appliance 13 includes a data-collection component that formats the diagnostic data in a packet and then passes the packet to a wireless transmitter, which sends it through a second cable 17 to an antenna 14. The antenna 14 radiates the packet through the airlink 9 to the wireless network. The data-collection component, for example, is a circuit board that interfaces to the vehicle's engine computer 16 through the vehicle's OBD-II connector, and the wireless transmitter is a radio modem.

The wireless appliance also includes a GPS module that attaches through a cable 19 to a GPS antenna 20 typically mounted outside the vehicle 12. The antenna receives standard GPS 'signals' 22 (i.e. radio frequency signals) from 3 or more orbiting GPS satellites 24. The signals indicate the position of the satellites relative to the vehicle, and are processed using standard triangulation algorithms to determine the vehicle's location. Once received, the signals pass from the antenna to the GPS module in the wireless appliance, which then processes them as described above to determine the GPS data. The wireless appliance 13 then formats the GPS data in a separate packet and, as described above, passes the packet to a wireless transmitter that sends it through the second cable 17 and antenna 14 to the wireless network 4.

Figure 2:
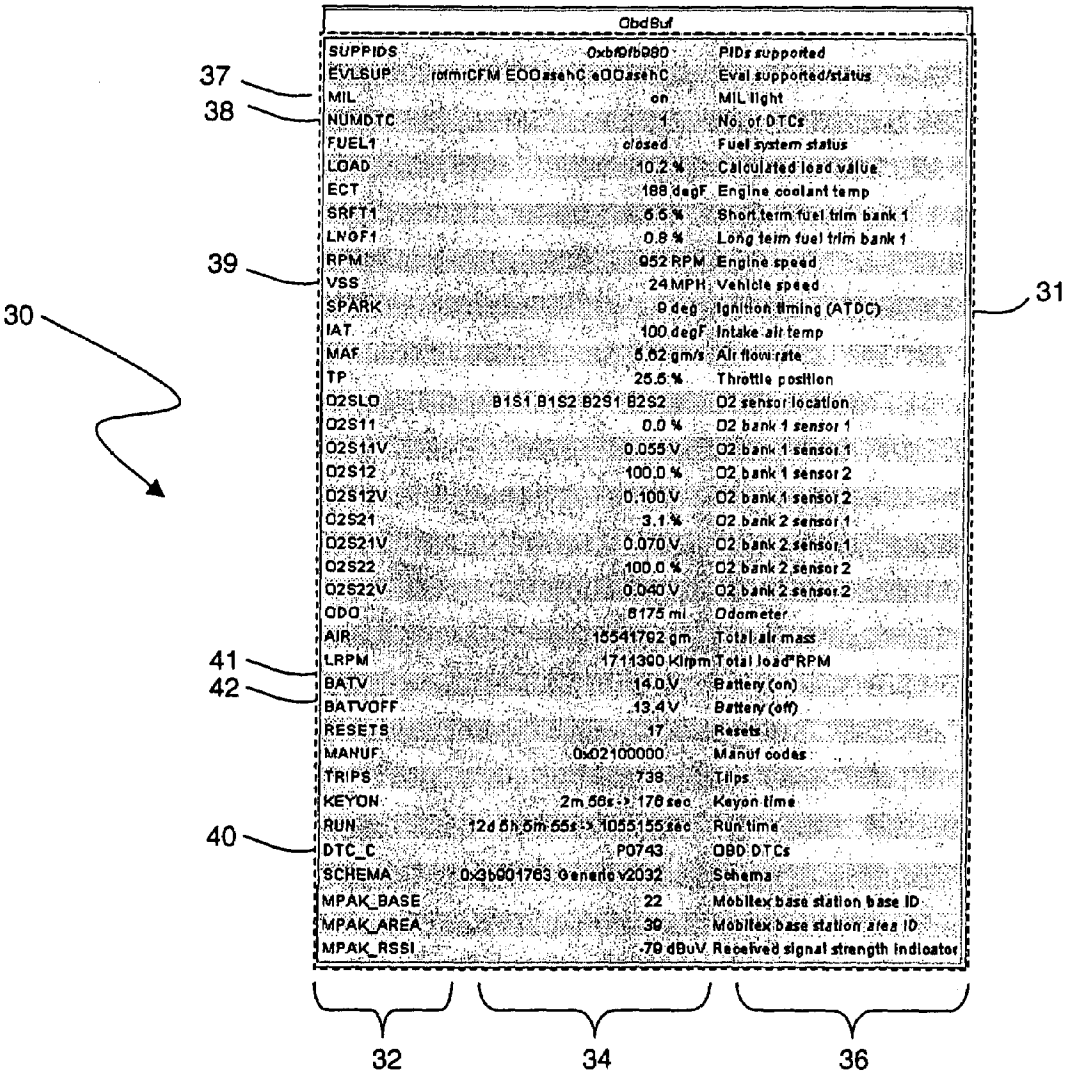
FIG. 2 is a screen capture of a web page that displays a vehicle's diagnostic data.

FIG. 2 shows a sample web page 30 that displays diagnostic data for a particular vehicle. The web page 30 includes a set of diagnostic data 31 and features fields listing an acronym 32, value and units 34, and brief description 36 for each datum. During typical operation, the wireless appliance periodically transmits sets of diagnostic data 31 like the one shown in FIG. 2 every 20 minutes. The wireless appliance can also transmit similar data sets at random time intervals in response to a query from the host computer system (sometimes called a 'ping').

Detailed descriptions of these data, and how they can be analyzed and displayed, are provided in the following patent applications, the contents of which are incorporated herein by reference: 1) U.S. Ser. No. 09/804,888, entitled INTERNET-BASED SYSTEM FOR MONITORING VEHICLES; U.S. Ser. No. 09/922,954, entitled INTERNET-BASED METHOD FOR DETERMINING A VEHICLE'S FUEL EFFICIENCY; U.S. Ser. No. 09/776,083, entitled WIRELESS DIAGNOSTIC SYSTEM FOR CHARACTERIZING MILEAGE, FUEL LEVEL, AND PERIOD OF OPERATION FOR ONE OR MORE VEHICLES; and U.S. Ser. No. 09/908,440, entitled INTERNET-BASED EMISSIONS TEST FOR VEHICLES.

The set of diagnostic data 31 in FIG. 2 features several datum that are particularly valuable when combined with GPS data indicating a vehicle's location. For example, a first datum 37 with the acronym 'MIL' indicates that the vehicles malfunction indicator light (located on the vehicle's dashboard and sometimes called a 'service engine soon' light) is lit. A second datum 38 ('NUMDTC', indicating the number of DTCs) and third datum 40 ('DTC_C', indicating the code of the actual DTC) indicate that there is a single DTC present, and its 5-digit code is 'P0743'. An automotive technician can review these data to determine what repairs are required for the vehicle. For example, 'P0743' indicates an electrical problem with the vehicle's torque converter clutch system. This DTC is classified as a 'generic code' meaning that it indicates the above-mentioned problem for all vehicles.

The set of diagnostic data 31 includes a datum 39 with the acronym 'VSS' that indicates the vehicle's speed. This datum, for example, indicates the corresponding vehicle is currently traveling 24 miles per hour. An algorithm can analyze these data along with GPS data to more precisely locate a stolen or disabled vehicle. Other useful parameters include datum 41, 42 ('BATV' and 'BATVOFF') indicating, respectively, that the vehicle's battery voltage is 14.0 volts when the vehicle's ignition is on, and 13.4 volts when it is turned off. A call center can analyze these parameters to assess whether a vehicle needs, e.g., a jump-start or similar roadside assistance.

Figure 3A:
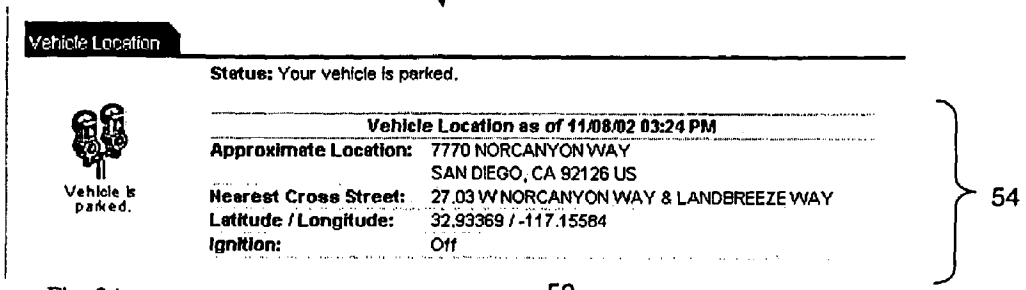
FIGS. 3*a* and 3*b* are web pages displaying, respectively, screen captures of a vehicle's numerical latitude and longitude and a map showing the vehicle's location.
Figure 3B:
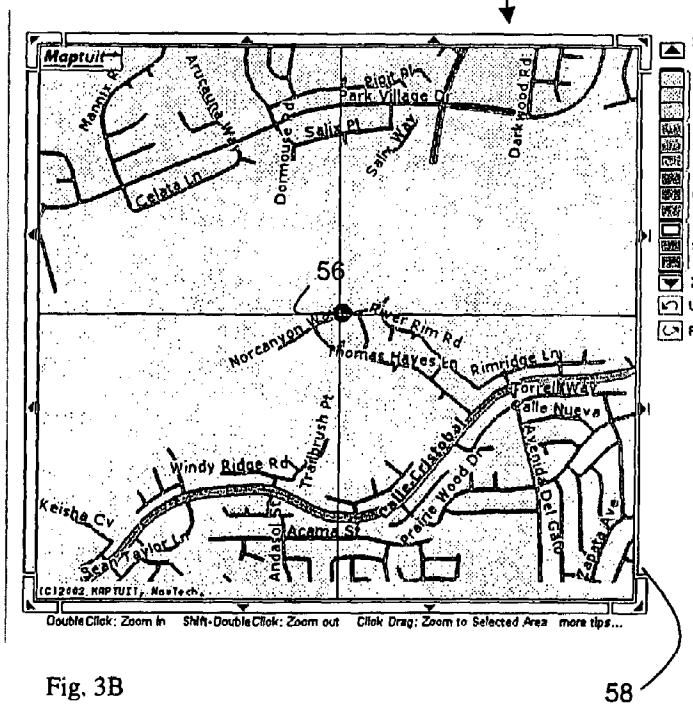

FIGS. 3A and 3B show screen shots 50, 52 displaying, respectively, GPS data 54 and a map 58 that together indicate a vehicle's location 56. In this case, the GPS data 54 includes the vehicle's latitude, longitude, a 'reverse geocode' of these data indicating a corresponding street address, the nearest cross street, and a status of the vehicle's ignition (i.e., 'on' or 'off' and whether or not the vehicle is parked or moving). The map 58 displays these coordinates in a graphical form relative to an area of, in this case, a few square miles. In typical embodiments, the screen shots 50, 52 are rendered each time the GPS data are periodically transmitted from a vehicle (e.g., every 1–2 minutes) and received by the data-processing component (18 in FIG. 1) of the website. Both the map and a database that translates the latitude and longitude into a reverse geocode are accessible though an Internet-based protocol, e.g. XML, Web Services, or TCP/IP. Companies such as MapTuit, MapQuest, and NavTech support maps and databases such as these.

Figure 4:
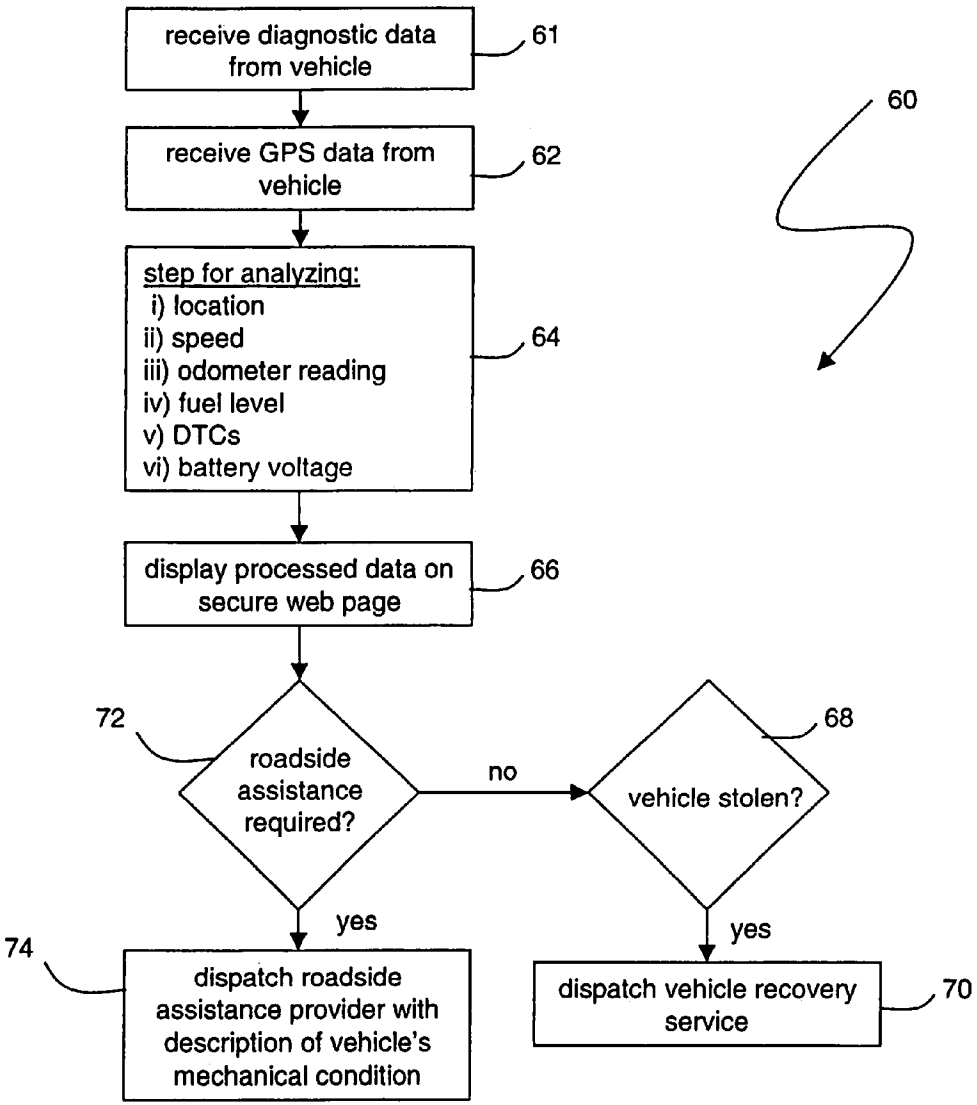
FIG. 4 is a flow chart showing an algorithm for simultaneously analyzing a vehicle's diagnostic and GPS data.

FIG. 4 shows in more detail how the data-processing component processes both the GPS and diagnostic data to provide, e.g., enhanced roadside assistance and theft-recovery services. Specifically, the figure shows a flow chart of an algorithm 60 used by the above-described system to analyze the diagnostic data of FIG. 2 and the GPS data of FIGS. 3*a*, 3*b*. The algorithm 60 can, for example, analyze both the vehicle's location and mechanical condition to provide information to a call center, data center, or central computer. These entities, in turn, can use this information to improve roadside assistance or stolen-vehicle recovery services.

The algorithm 60 features steps 61, 62 where the data-processing component receives the vehicle's GPS and diagnostic data through the wireless network. In step 64 the data are analyzed to determine properties such as the vehicle's location and the following: 1) speed; 2) odometer reading; 3) fuel level; 4) DTCs; and/or 5) battery voltage. In step 64 the algorithm uses these data to determine, e.g., for roadside assistance purposes: i) work required to repair the vehicle; ii) whether or not to re-fuel or jump-start the vehicle; and iii) a proximal service stations for performing these repairs.

Similarly, when the algorithm 60 is used for recovering a stolen vehicle, step 64 uses these data to determine: i) whether or not the vehicle's ignition is on; ii) whether or not the vehicle is moving or parked; iii) miles traveled since last data transmission; and iv) buildings or structures where the vehicle may be stored.

Following step 64, step 66 displays any processed data on one or more secure web pages (similar to those shown in FIGS. 2, 3A, 3B, with additional pages or data fields for displaying the above-described information). If roadside assistance is required, as in step 72, the algorithm 60 dispatches a roadside-assistance provider with instructions describing the vehicle's mechanical condition, as step 74, and any necessary repairs. Similarly, steps 68 and 70 show, respectively, how the algorithm 60 determines that the vehicle has been stolen and consequently dispatches a vehicle (e.g. a police squad car) for recovering the stolen vehicle.

During step 64 the algorithm 60 can additionally analyze the vehicle's location (from the GPS data) and speed (from the diagnostic data) to determine the vehicle's location and 'location age'. The location age effectively indicates the error associated with the vehicle's location. The algorithm 60 calculates location age using the last GPS-determined location, a time period between a transmission containing these data and a subsequent transmission that lacks a successful GPS-determined location (because, e.g., of poor GPS coverage), and the vehicle's GPS-determined speed between these two transmissions. The product of the time period and speed yields a location age having units of distance. A non-zero GPS age, for example, results when a moving vehicle originally located in good GPS coverage drives to a new location that has poor GPS coverage.

Figure 5B:
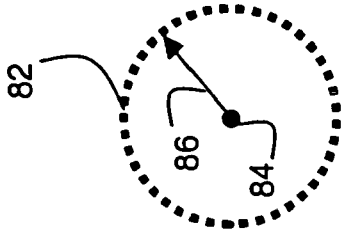
FIGS. 5A, 5B, 5C are, respectively, a map showing a vehicle's location and its 'location age', and close-up views of a diagrams indicating different graphical ways of displaying the vehicle's 'location age.'
Figure 5C:
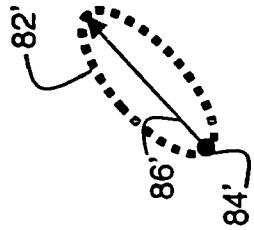
Figure 5A:
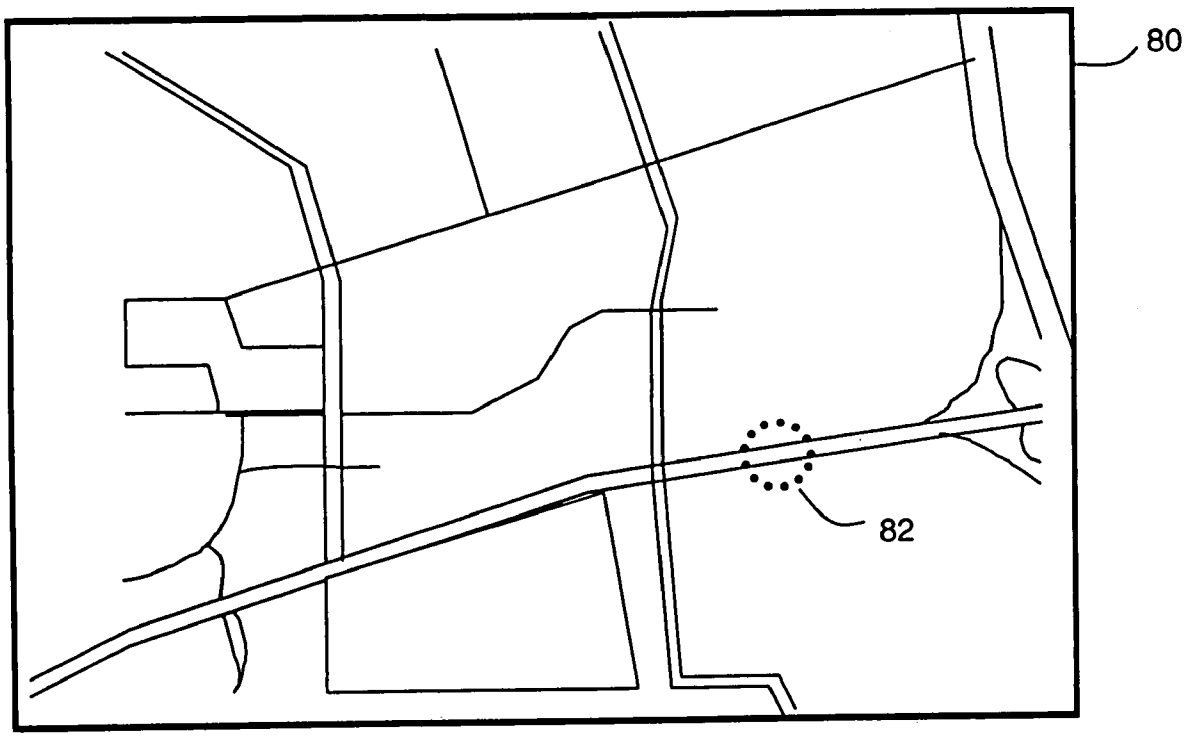

Referring to FIGS. 5A–C, a map 80 rendered on a website features a region 82 that indicates a vehicle's location and location age. Internet-based mapping software generates both the map 80 and the region 82 by processing GPS data transmitted by the vehicle. A single point 84 indicates the vehicle's approximate location, and a vector 86 indicates the location age. As described above, the location age indicates the error of the displayed location, and thus the vehicle's location is within a radius defined by the vector 86. FIG. 5C shows another embodiment for displaying the location age. In this case, a vehicle's GPS-determined location and heading are processed to generate a region 82' featuring a single point 84' located at one end of a vector 86'. The region 82' is an ellipse representing the vehicle's location and location age.

GPS and diagnostic data can also be combined to provide an accurate GPS location, even when the wireless appliance is out of 'GPS coverage'. Here, GPS coverage refers to regions where the GPS antenna can successfully receive signals from the orbiting GPS satellites. GPS coverage is typically 'line of sight', meaning that the wireless appliance is typically out of coverage when it is indoors or positioned under large structures, such as a building.

Figure 6:
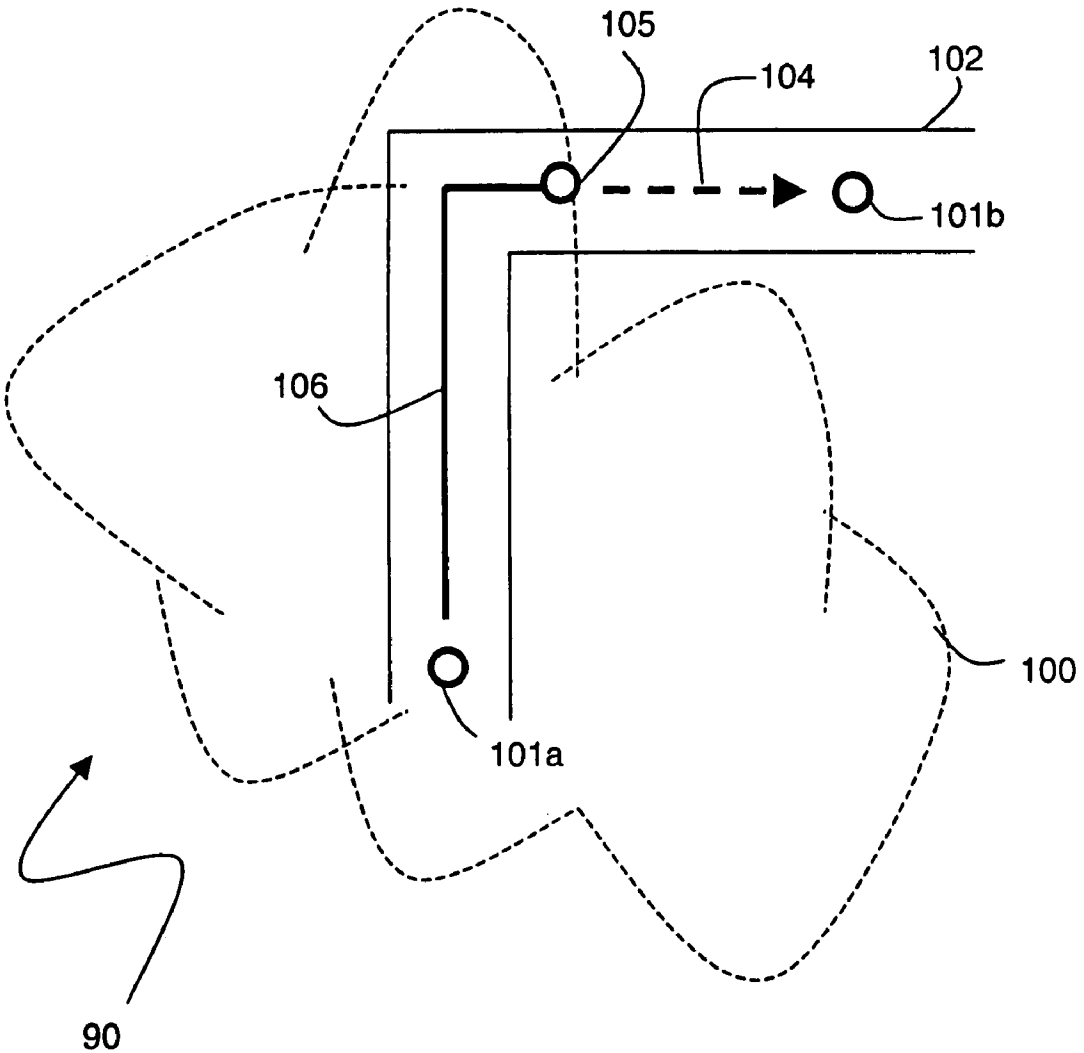
FIG. 6 is a schematic drawing of a region of GPS coverage overlaid on a map to indicate use of GPS and diagnostic (i.e. speed) data to accurately determine a vehicle's location.

FIG. 6 shows a close-up view of a map 90 that features a road 102 superimposed with a region 100 indicating the GPS coverage. The map also includes a first marker 101*a* indicating a vehicle's initial position, and a line 106 indicating a path driven by the vehicle while in the region 100 of GPS coverage. At a point 105 the vehicle is no longer in GPS coverage (e.g., the vehicle could be driving into a large structure, such as a tunnel), and thus can no longer receive GPS signals from the orbiting satellites. At this point 105, the in-vehicle wireless appliance senses that it is no longer in coverage. Assuming that the wireless appliance can still communicate with the wireless network (which is typically the case, even when the appliance is not in sight of a wireless base station), it transmits the GPS-determined location of the point 105 and the vehicle's speed determined from the diagnostic data. Using the speed and the time between transmissions, the data-processing component in FIG. 1 calculates the distance traveled, indicated by a line 104, while the appliance is out of GPS coverage. This distance and the GPS-determined location of point 105 are used to determine the vehicle's next location, indicated by marker 101*b*. The wireless appliance transmits these data, which effectively represent the vehicle's location.

Figure 7:
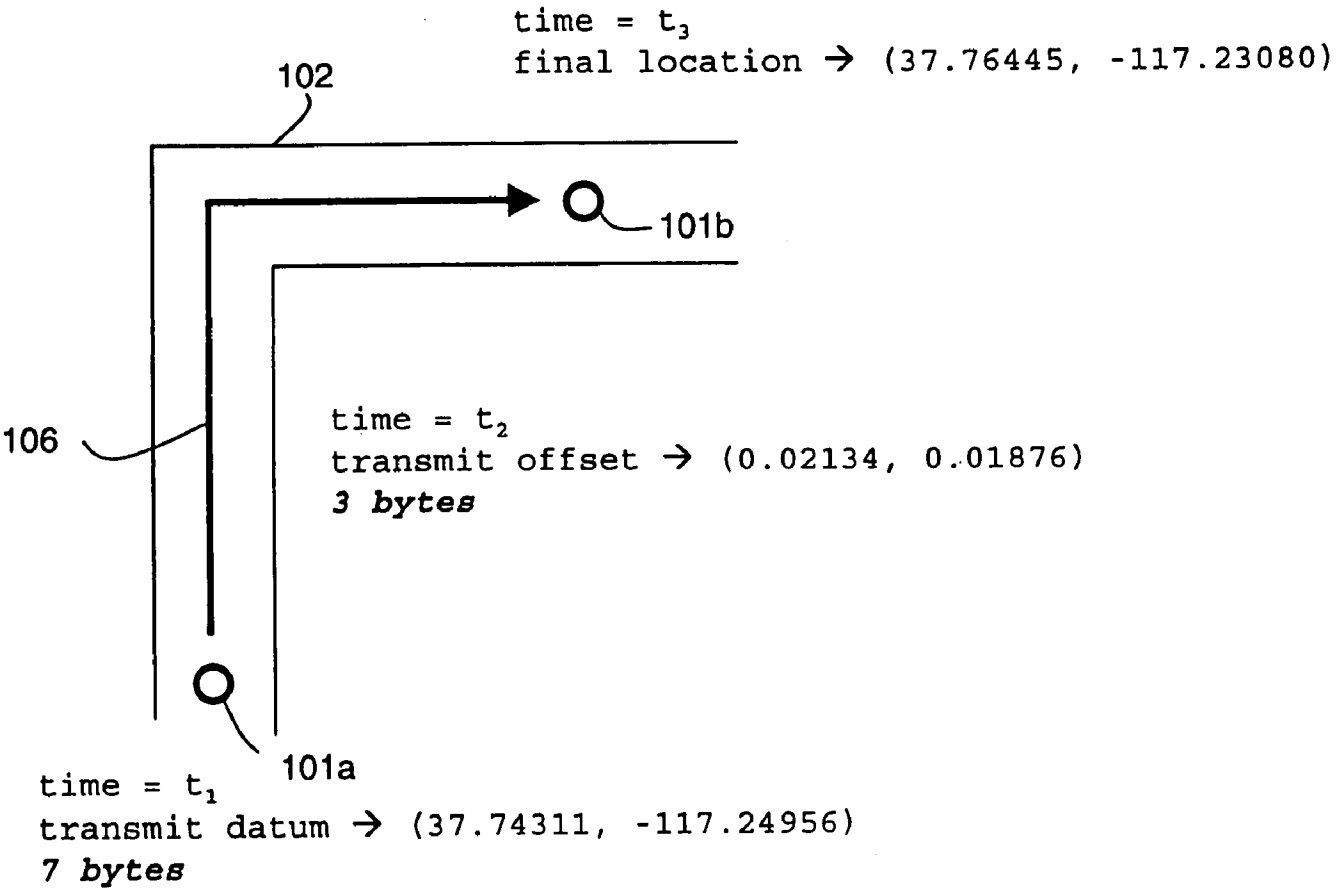
FIG. 7 is a schematic drawing of a map indicating how the wireless appliance transmits GPS 'datum' and 'offsets.'

FIG. 7 indicates a method, similar to that described above, that determines a vehicle's location without transmitting a full set of GPS data. As indicated by the figure, at time $t_1$ the wireless appliance is located at a first marker 101*a* and transmits a GPS 'datum' featuring both latitude and longitude. These parameters occupy 7 bytes in a packet sent over the wireless network. The vehicle travels during time $t_2$ to a location indicated by a second marker 101*b*. At the end of this time period the wireless appliance transmits an 'offset' representing the difference in the latitude and longitude between locations indicated, respectively, by the first and second markers 101*a*, 101*b*. The offset occupies only 3 bytes in the packet sent over the wireless network. Transmitting GPS offsets instead of full GPS datum reduces airtime costs incurred since wireless networks typically employ a per-byte billing model.

Figure 8B:
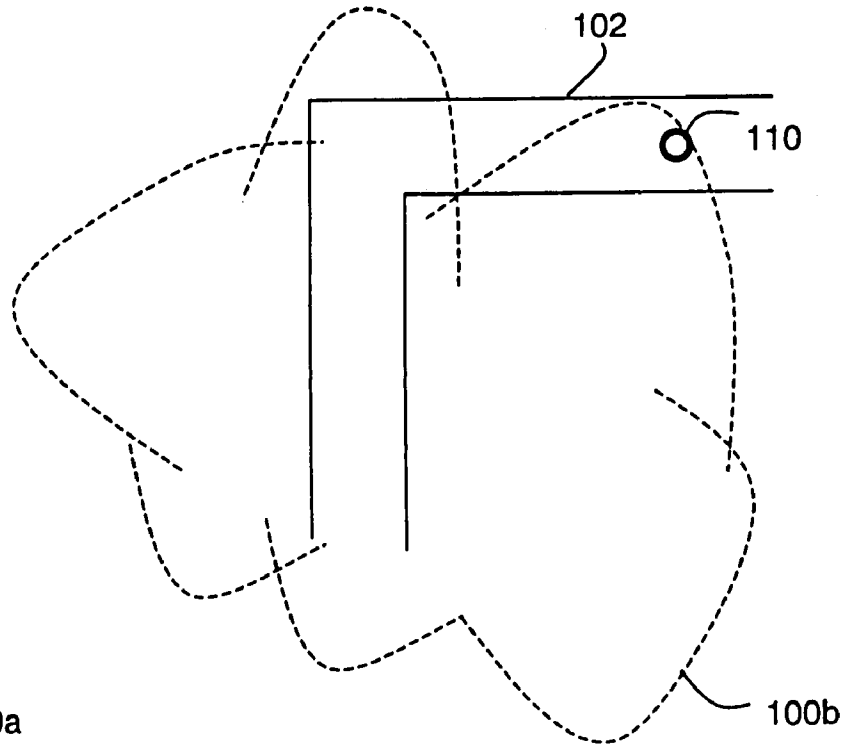
FIGS. 8A and 8B are, respectively, schematic drawings of a map and a region of GPS coverage at times $t_1$ and $t_2$.
Figure 8A:
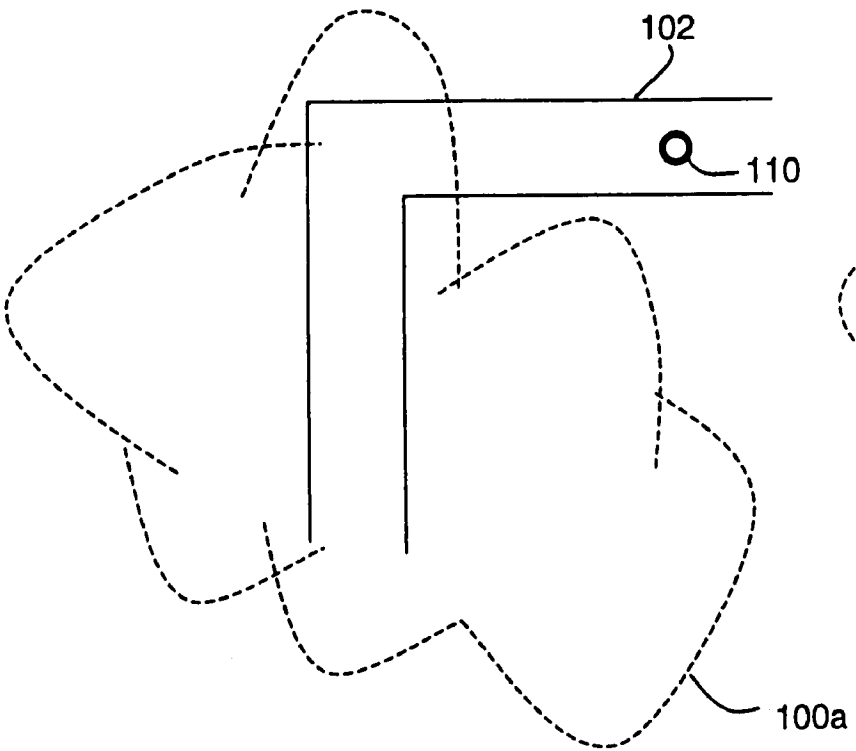

As indicated by FIGS. 8A and 8B, when located at a marker 110 the wireless appliance may be out of GPS coverage, as indicated by a region 100*a* present at time=$t_1$. At this time the appliance cannot obtain GPS data since the orbiting GPS satellites cannot communicate with the GPS antenna present on the vehicle. As indicated by FIG. 8B, however, GPS coverage can fluctuate over time. For example, at time=$t_2$ the GPS coverage, indicated by the region 100*b*, fluctuates so that the wireless appliance can obtain GPS data and transmit these data over the wireless network. Based on the above, in one embodiment the wireless appliance is continually powered, even after the vehicle is shut off. If it is out of coverage, it can persistently attempt to obtain GPS data since the coverage may fluctuate over time. These data can then be transmitted as described above and used to locate the vehicle.

Figure 9:
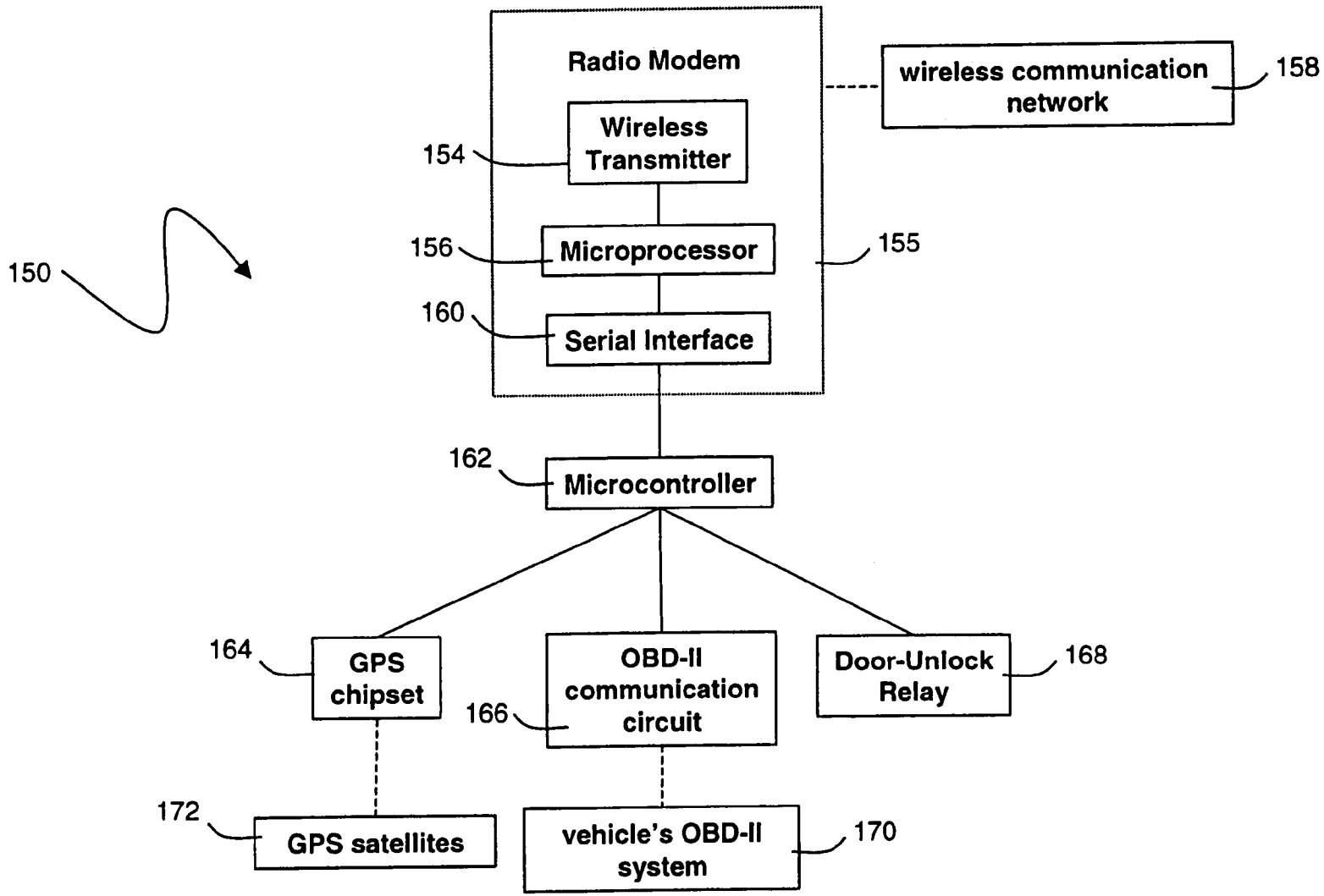
FIG. 9 is a schematic drawing of electrical components used in the wireless appliance.

FIG. 9 shows a schematic drawing of a wireless appliance 150 and its associated electronic components used to transmit the above-described data. The wireless appliance is described in detail in U.S. Ser. No. 09/776,106, entitled WIRELESS DIAGNOSTIC SYSTEM FOR VEHICLES, the contents of which are incorporated herein by reference. The appliance 150 features a radio modem 155 that communicates with a wireless communication network 158. The radio modem, in turn, features a wireless transmitter 154, a microprocessor 156, and a serial interface 160. Such radio modems include the R907M, manufactured by Research in Motion, located in Waterloo, Ontario, Canada (www.rim-.com).

The microprocessor 156 of the radio modem 155 connects through the serial interface 160 to an external microcontroller 162. The microcontroller 162 manages different functions of the wireless appliance 150, such as communication with both a GPS chipset 164 and an OBD-II communication circuit 166. As described above, data from these components are transferred from the microcontroller 162 to the microprocessor 156 through the serial interface 160. There, they are formatted into packets by the radio modem 155 and transmitted over the wireless network 158. The GPS chipset 164 generates GPS data following communication with orbiting GPS satellites 172, while the OBD-II communication circuit 166 generates diagnostic data following communication with the vehicle's OBD-II system 170. In other embodiments, the microcontroller 162 communicates with a door-unlock relay 168 that, in response to a signal, opens or closes the locks on the vehicle's door. This allows, e.g., a call center to remotely open the doors of a vehicle by sending a signal from a website through the Internet and the wireless network.

Figure 10A:
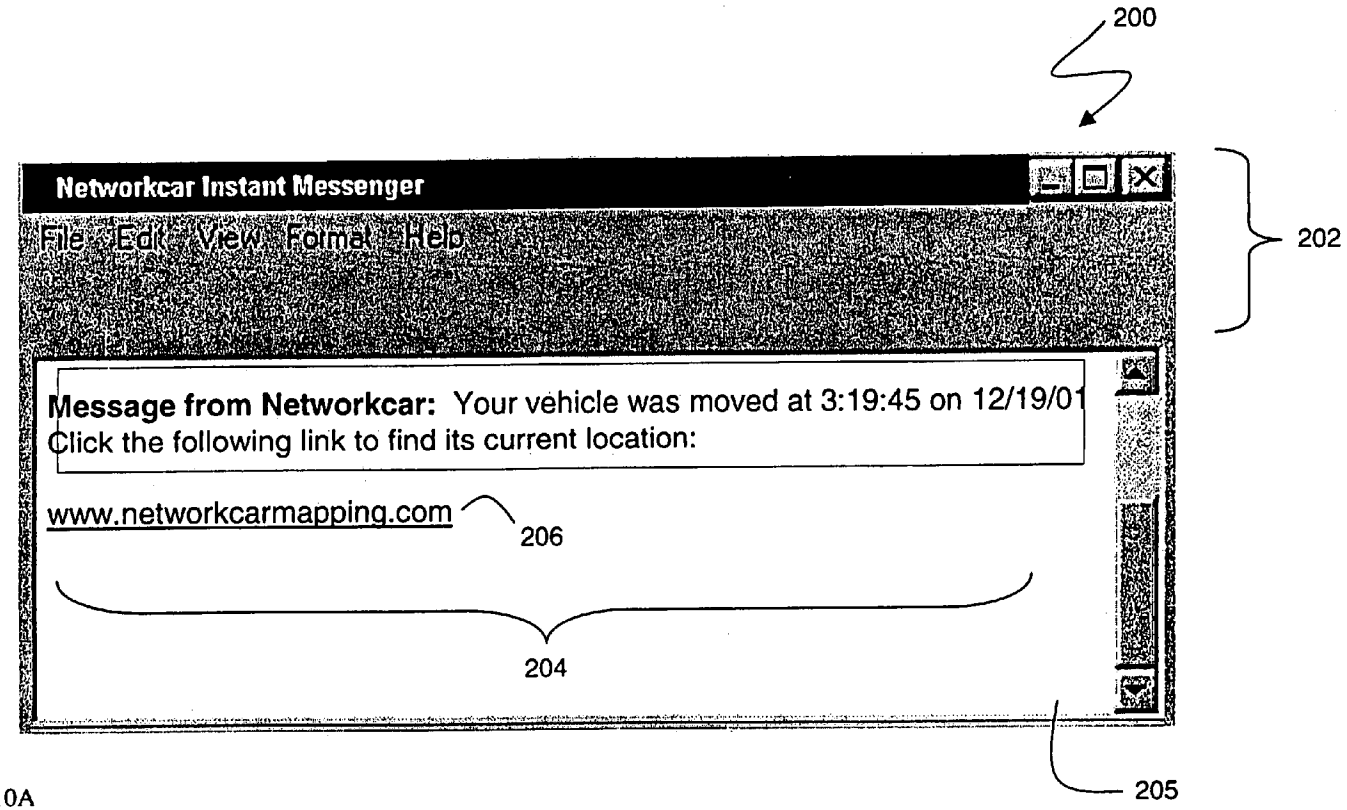
FIGS. 10A and 10B are, respectively, screen shots of an internet-enabled instant message and a instant message icon used to indicate a stolen vehicle.

FIG. 10A shows how internet-based instant messaging, as described above, can identify a stolen or towed vehicle. Software for the instant messaging is typically downloaded and automatically installed onto the user's computer from an internet-accessible website (e.g., www.networkcar.com). The user then 'activates' the software, e.g. after parking the vehicle, so that an instant message is sent when the vehicle is moved. This can 'virtually lock' the vehicle. For example, the user can activate the software by clicking on an icon on their computer desktop, which in turn activates a software piece that generates the instant message when it receives data from the vehicle indicating it has been moved.

FIG. 10A, for example, shows a screen shot of such an instant message 200 that appears directly on a user's computer screen. The message is initiated when the GPS chipset (described above with reference to FIG. 9) in the wireless appliance reports a change in the vehicle's position. These data are then sent wirelessly using the radio modem to the data-processing component (described above with reference to FIG. 1), where they are analyzed to indicate the change in the vehicle's position and send the instant message 200.

The instant message 200 features a region 205 that displays a text message 204 indicating a time and date when the vehicle was moved. The text message 204 also includes a link 206 to a mapping website (described below with reference to FIG. 11) that shows the vehicle's time-dependent location. The instant message 200 also includes a header 202 that includes standard Windows®-based features (e.g., 'File', 'Edit') that can be used, e.g., to print, store, or edit the message. A user whose vehicle is stolen can communicate its time-dependent location to the police, who in turn can locate the stolen vehicle.

Figure 10B:
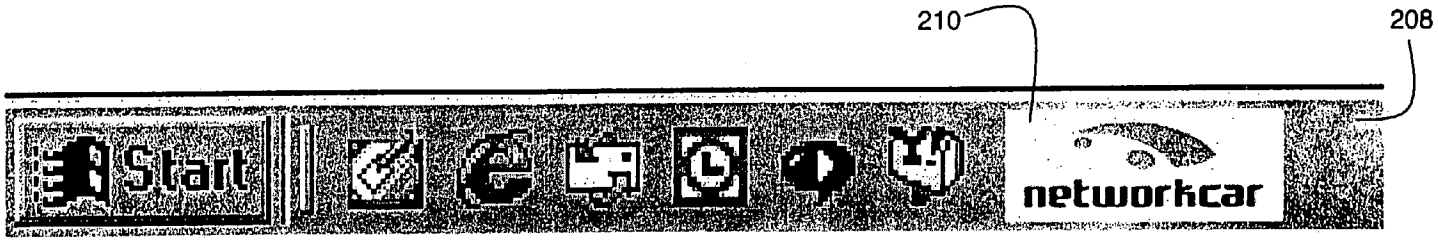

Referring to FIG. 10B, the above-described automatic installation processes loads an icon 210 onto a 'toolbar' 208 available on conventional Windows®-based operating systems (e.g., Windows® 2000). The user then parks the vehicle and clicks on the icon 210 to activate (or deactivate) the software as described above.

Figure 11:
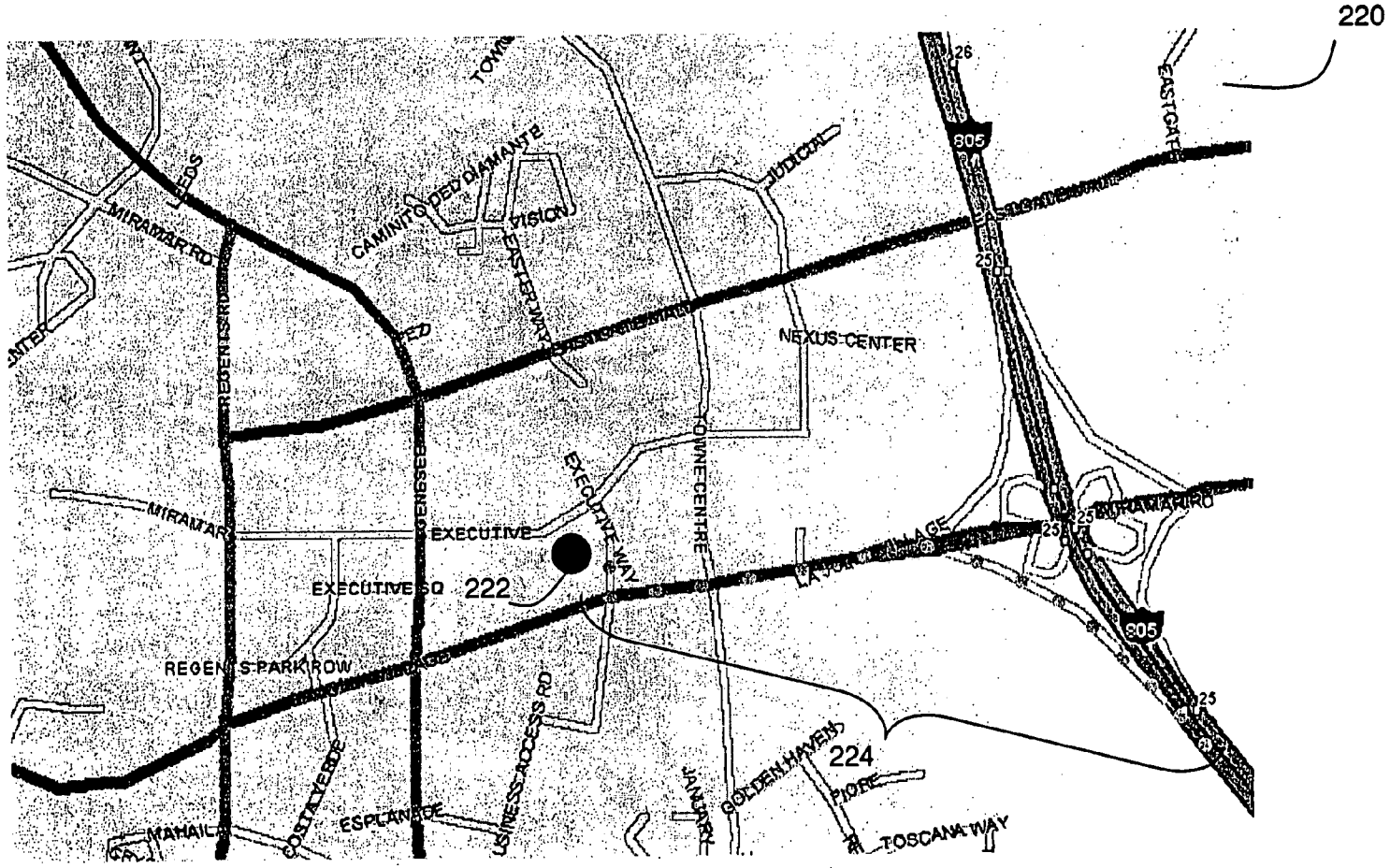
FIG. 11 is a screen shot showing a map and a tracked vehicle that is accessed from the instant message of FIG. 10A.

FIG. 11 shows a website that renders a map 220 when the user clicks on the link 206 shown in FIG. 10A. The map 220 shows a first icon 222 that indicates the vehicle's initial position. A series of second icons 224 indicating the vehicle's time-dependent position appear on the map 220 while the vehicle is in motion. As shown in the figure, the vehicle is moving from its initial position, along a first road ('La Jolla Village Drive'), towards a freeway ('805'). Using this methodology, the vehicle's position can be rapidly updated (e.g., every 15 seconds) to accurately track the vehicle.

Other embodiments are also within the scope of the invention. In particular, the web pages used to display the data can take many different forms, as can the manner in which the data are displayed. Similarly, the icons and maps described above can have any graphical format. For example, for applications relating to instant messaging, an icon representing a school may be used to indicate if a vehicle is located and moved from the user's school. Similar icons representing other locations may also be used. Maps can be rendered using links to internet-based software (e.g., software offered by Maptuit® or Mapquest®) or by using stand-alone software pieces (e.g., Street Atlas®) residing on a client's computer. Both types of mapping software can be track the user's vehicle or a separate vehicle associated with the user.

Web pages are typically written in a computer language such as 'HTML' (hypertext mark-up language), and may also contain computer code written in languages such as java for performing certain functions (e.g., sorting of names). The web pages are also associated with database software, e.g. an Oracle-based system, that is used to store and access data. Equivalent versions of these computer languages and software can also be used.

Different web pages may be designed and accessed depending on the end-user. As described above, individual users have access to web pages that only show data for the particular vehicle, while organizations that support a large number of vehicles (e.g. call centers, automotive dealerships, the EPA, California Air Resources Board, or an emissions-testing organization) have access to web pages that contain data from a collection of vehicles. These data, for example, can be sorted and analyzed depending on vehicle make, model, odometer calculation, and geographic location. The graphical content and functionality of the web pages may vary substantially from what is shown in the above-described figures. In addition, web pages may also be formatted using standard wireless access protocols (WAP) so that they can be accessed using wireless devices such as cellular telephones, personal digital assistants (PDAs), and related devices.

The web pages also support a wide range of algorithms that can be used to analyze data once it is extracted from the data packets. In general, the measurement could be performed after analyzing one or more data parameters using any type of algorithm. These algorithms range from the relatively simple (e.g., determining mileage values for each vehicle in a fleet) to the complex (e.g., predictive engine diagnoses using 'data mining' techniques). Data analysis may be used to characterize an individual vehicle as described above, or a collection of vehicles, and can be used with a single data set or a collection of historical data. Algorithms used to characterize a collection of vehicles can be used, for example, for remote vehicle or parts surveys, to characterize a vehicle's performance in specific geographic locations, or to characterize traffic.

The packets described above are transmitted at a pre-set time intervals (e.g., once every 20 minutes for diagnostic data; once every minute for GPS data). Alternatively, the transmission is performed once authorized by a user of the system (e.g., using a button on the website). In still other embodiments, the measurement is performed when a data parameter (e.g. engine coolant temperature) exceeded a predetermined value. Or a third party, such as the call center, could initiate the test.

In other embodiments, the radio modem used to transmit the GPS data may employ a terrestrial GPS system, such as that available on modems designed by Qualcomm, Inc. In this case GPS data is determined through communication with terrestrial base stations; communication with orbiting GPS satellites is not required. Or the system could employ terrestrial-assisted GPS, where signals from both satellites and terrestrial base stations are used to locate the vehicle. In addition, the wireless appliance may be interfaced to other sensors deployed in the vehicle to monitor additional data. For example, sensors for measuring tire pressure and temperature may be deployed in the vehicle and interfaced to the appliance so that data relating the tires' performance can be transmitted to the host computer system. These data can then be further analyzed along with the diagnostic and GPS data.

In other embodiments, the antennae used to transmit the data packets or receive the GPS signals are embedded in the wireless appliance, rather than being exposed. These antennae can also be disposed or hidden in a variety of locations in the vehicle. In still other embodiments, the above-described system is used to locate vehicle or things other than cars and trucks, such as industrial equipment.

In still other embodiments, other location-based applications can be combined with the above-mentioned mapping capabilities to provide real-time internet-based services involving maps. For example, data indicating traffic can be combined with mapping software to generate internet-based, real-time 'traffic maps' that graphically indicate traffic patterns. In this case data such as vehicle speed could be generated and transmitted by the in-vehicle wireless appliance described above. These data can also be used, for example, to generate an optimum travel route that minimizes traffic delays. Similarly, algorithms used to calculate vehicle emissions can be combined with the mapping software to generate real-time 'emissions maps' that graphically indicate pollutants such as oxides of nitrogen, carbon monoxide, or hydrocarbon emissions.

Still other embodiments are within the scope of the following claims.

What is claimed is:

1. A method of characterizing a vehicle, comprising:

(a) wirelessly receiving, by a host computer from a vehicle, a diagnostic data set and a location data set, the diagnostic data set comprising at least one diagnostic datum, the location data set comprising at least one GPS datum;

(b) analyzing both the diagnostic and location data sets to characterize the vehicle;

(c) displaying the results of the analyzing on at least one internet-accessible web page; and (d) repeating the wirelessly receiving and analyzing for a plurality of vehicles, wherein the displaying the results includes displaying a real-time pattern map associated with the plurality of vehicles, wherein the pattern map displays emissions patterns.

2. A programmed apparatus, programmed to execute a method of detecting a change in a vehicle's location, comprising:

(a) wirelessly receiving, by a host computer from a vehicle, a location data set comprising at least one GPS datum;

(b) analyzing the received location data set to characterize a change in the vehicle's location, wherein the analyzing comprises comparing a GPS datum determined from the location data set with a previous GPS datum to determine a change in the vehicle's location;

(c) based at least in part on the analyzing, electronically reporting the vehicle's location, the reporting including at least one of sending an electronic mail message, sending an electronic instant message, and generating a phone call, wherein the reporting includes sending the vehicle's location and an internet-based link to a map that displays the vehicle's location;

(d) dispatching at least a second vehicle to attempt to recover the vehicle; and (e) notifying a law enforcement entity of the vehicle's location, wherein the vehicle is a stolen vehicle.

3. A programmed apparatus, programmed to execute a method of detecting a change in a vehicle's location, comprising:

(a) wirelessly receiving, by a host computer from a vehicle, a diagnostic data set and a location data set, the diagnostic data set comprising at least one diagnostic datum, the location data set comprising at least one GPS datum;

(b) analyzing both the diagnostic and location data sets to characterize the vehicle, wherein the analyzing includes analyzing the diagnostic data set to determine the vehicle's speed, and wherein the analyzing includes analyzing both the GPS datum and the vehicle's speed from the diagnostic data set to determine the vehicle's location; and (c) based at least in part on the analyzing, electronically reporting the vehicle's location, wherein the electronically reporting comprises sending the vehicle's location and an internet-based link to a map that displays the vehicle's location.

4. The programmed apparatus of claim 3, wherein the sending includes sending an internet-based link to a map that displays the current vehicle's location and at least one previous location.

5. The programmed apparatus of claim 4, wherein the sending includes sending an internet-based link to a map that displays an internet-based map and a track indicating a route that the vehicle has traveled.

6. A machine-readable medium encoded with a plurality of processor-executable instructions for:

(a) wirelessly receiving, by a host computer from a vehicle, a diagnostic data set and a location data set, the diagnostic data set comprising at least one diagnostic datum, the location data set comprising at least one GPS datum;

(b) analyzing both the diagnostic and location data sets to characterize the vehicle, wherein the analyzing includes analyzing the diagnostic data set to determine the vehicle's speed, and wherein the analyzing includes analyzing both the GPS datum and the vehicle's speed from the diagnostic data set to determine the vehicle's location; and (c) based at least in part on the analyzing, electronically reporting the vehicle's location, wherein the electronically reporting comprises sending a message, wherein the sending includes sending an internet-based link to a map that displays the vehicle's location.

7. A graphical user interface for displaying information associated with a detected change in a-vehicle's location, comprising:

a viewing device displaying a graphical user interface including, (a) a message interface including a hyperlink and information associated with a detected change in a vehicle's location; and (b) a map representation at least in part depicting the vehicle's location, wherein the hyperlink includes a link to the map representation.

8. The graphical user interface of claim 7, wherein the message interface is associated with an instant message.

9. The graphical user interface of claim 7, wherein the information includes text information.

10. The graphical user interface of claim 7, wherein the information is at least in part indicative of when the vehicle was moved.

11. The graphical user interface of claim 7, wherein the map representation is provided in a website.

12. The graphical user interface of claim 7, wherein the map representation includes an initial location of the vehicle.

13. The graphical user interface of claim 12, wherein the map representation depicts a route traversed by the vehicle.

14. The graphical user interface of claim 7, wherein at least a portion of the displayed graphical user interface is formatted using at least one wireless access protocol (WAP).

15. The graphical user interface of claim 7, wherein the viewing device is one of a cellular telephone, a personal digital assistant (PDA), and a computer.

* * * * *